US009708765B2

(12) United States Patent
Gingras

(10) Patent No.: US 9,708,765 B2
(45) Date of Patent: Jul. 18, 2017

(54) ROTOR REFINER PLATE ELEMENT FOR COUNTER-ROTATING REFINER HAVING CURVED BARS AND SERRATED LEADING EDGES

(75) Inventor: Luc Gingras, Harrogate (GB)

(73) Assignee: Andritz Inc., Glen Falls, NY (US)

( * ) Notice: Subject to any disclaimer, the term of this patent is extended or adjusted under 35 U.S.C. 154(b) by 711 days.

(21) Appl. No.: 13/547,144

(22) Filed: Jul. 12, 2012

(65) Prior Publication Data

US 2013/0015281 A1 Jan. 17, 2013

Related U.S. Application Data

(60) Provisional application No. 61/507,450, filed on Jul. 13, 2011.

(51) Int. Cl.
*B02C 7/12* (2006.01)
*D21D 1/30* (2006.01)

(52) U.S. Cl.
CPC ..... *D21D 1/306* (2013.01); *D21D 1/30* (2013.01)

(58) Field of Classification Search
CPC ..... D21D 1/30; D21D 1/306
USPC ..... 241/261.2, 261.3, 296
See application file for complete search history.

(56) References Cited

U.S. PATENT DOCUMENTS 804,738 A 11/1905 Kreps
827,059 A 7/1906 Davis
1,187,360 A * 6/1916 Martin ..... B02C 7/12 241/296
1,609,717 A 12/1926 Holland-Letz
3,473,745 A * 10/1969 Soars, Jr. ..... B02C 7/12 241/298
4,023,737 A 5/1977 Leider et al.
4,712,745 A 12/1987 Leith
(Continued)

FOREIGN PATENT DOCUMENTS

FI 53469 1/1978
JP 3-113086 A 5/1991
(Continued)

OTHER PUBLICATIONS

European Search Report mailed Sep. 20, 2012.
Japanese Patent Office action, pp. 1-6 (Jan. 26, 2016).

*Primary Examiner* — Faye Francis
*Assistant Examiner* — Onekki Jolly
(74) *Attorney, Agent, or Firm* — Kerri A. Hochgesang; Robert Joseph Hornung

(57) ABSTRACT

A refining plate segment for a mechanical refiner of lignocellulosic material including: a refining surface on a substrate, wherein the refining surface faces a refining surface of an opposing refiner plate, the refining surface including bars and grooves between the bars, wherein an angle of each bar with respect to a radial line corresponding to the bar increases at least 15 degrees along a radially outward direction, and the angle is a holdback angle in a range of 10 to 45 degrees at the periphery of the refining surface, and wherein the bars each include a leading sidewall having an irregular surface, wherein the irregular surface includes protrusions extending outwardly from the sidewall towards a sidewall on an adjacent bar and the irregular surface extends from at or near the outer periphery of the refining surface extends radially inwardly along the bars without reaching an inlet of the refining surface.

40 Claims, 6 Drawing Sheets

(56) References Cited

U.S. PATENT DOCUMENTS

| | | | | |
|---|---|---|---|---|
| 5,165,592 | A | 11/1992 | Wasikowski | |
| 5,362,003 | A | 11/1994 | Virving | |
| 5,383,617 | A * | 1/1995 | Deuchars | D21D 1/306 241/261.2 |
| 5,425,508 | A | 6/1995 | Chaney | |
| 5,467,931 | A | 11/1995 | Dodd | |
| 5,683,048 | A | 11/1997 | Virving | |
| 5,690,286 | A | 11/1997 | Dodd et al. | |
| 5,695,136 | A | 12/1997 | Rohden | |
| 6,276,622 | B1 | 8/2001 | Obitz | |
| 6,592,062 | B1 | 7/2003 | Virving | |
| 7,419,112 | B2 | 9/2008 | Sjostrom et al. | |
| 7,900,862 | B2 | 3/2011 | Gingras | |
| 8,157,195 | B2 | 4/2012 | Gingras | |
| 2006/0006265 | A1 | 1/2006 | Sabourin et al. | |
| 2008/0191078 | A1* | 8/2008 | Gingras | 241/298 |
| 2011/0155828 | A1* | 6/2011 | Gingras | 241/24.29 |
| 2014/0131489 | A1* | 5/2014 | Gingras | 241/28 |

FOREIGN PATENT DOCUMENTS

| | | | | |
|---|---|---|---|---|
| JP | 3-92793 | A | 9/1991 | |
| JP | 2000-502600 | A | 3/2000 | |
| JP | 2013-44084 | A | 3/2013 | |
| SE | 513 807 | | 11/2000 | |
| WO | 00/56459 | | 9/2000 | |
| WO | 2008/098153 | | 8/2008 | |
| WO | WO 2008098153 | A1 * | 8/2008 | D21D 1/30 |

* cited by examiner

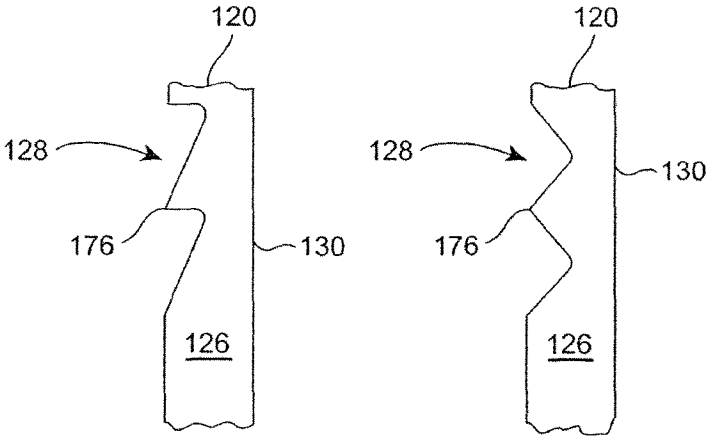
Figure 9
Figure 10
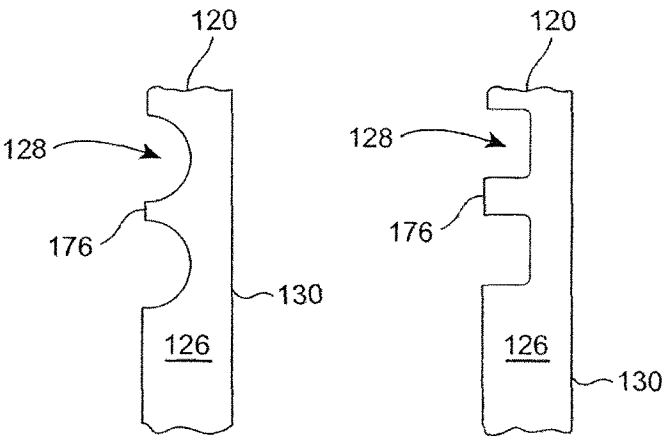
Figure 11
Figure 12
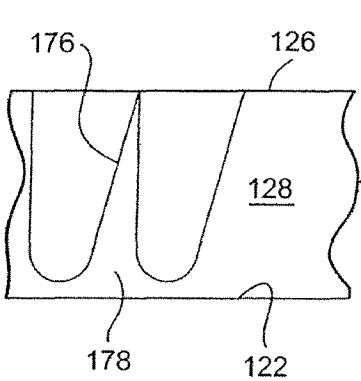
Figure 13
Figure 14

ROTOR REFINER PLATE ELEMENT FOR COUNTER-ROTATING REFINER HAVING CURVED BARS AND SERRATED LEADING EDGES

RELATED APPLICATION

This application claims the benefit of provisional application No. 61/507,450 filed Jul. 13, 2011, which is incorporated in its entirety by reference.

BACKGROUND OF THE INVENTION

This invention relates to disc refiners for ligno-cellulosic materials, such as disc refiners used for producing mechanical pulp, thermomechanical pulp and a variety of chemi-thermomechanical pulps (collectively referred to as mechanical pulps and mechanical pulping processes).

In counter-rotating refiners used in the mechanical pulping processes, raw material, typically wood or other ligno-cellulosic material (collectively referred to as wood chips), is fed through the middle of one of a refiners discs and propelled outwards by a strong centrifugal force created by the rotation of one or both rotor discs. Refiner plates are mounted on each of the opposing faces of the refiner discs. The wood chips move between the opposing refiner plates in a generally radially direction to the outer perimeter of the plates and disc.

The refiner discs conventionally operate at rotational speeds of 1200 to 1800 revolutions per minute (RPM). While the wood chips are between the discs, energy is transferred to the material via a refiner plates attached to the discs. The refiner plates generally feature a pattern of bars and grooves, as well as dams, which together provide a repeated compression and shear actions on the lingo-cellulosic fiber material. The compression and shear actions acting on the material separates of ligno-cellulosic fibers from the raw material, provides a certain amount of development or fibrillation of the material, and generates some fiber cutting which is usually less desirable. The fiber separation and development is necessary for transforming the raw wood chips into a suitable board or paper making fiber component.

In the mechanical pulping process, a large amount of friction occurs, such as between the wood chips and the refiner plates. This friction reduces the energy efficiency of the process. It has been estimated that the efficiency of the energy applied in mechanical pulping is in the order of 10 percent (%) to 15%.

Efforts to develop refiner plates which work at higher energy efficiency e.g., lower friction, have been achieved and typically involve reducing the operating gap between the discs. Conventional techniques for improving energy efficiencies typically involve design features on the front face of refiner plate segments that usually speed up the feed of wood chips across the refining zone(s) on the refiner plates. These techniques often result in reducing the thickness of the fibrous pad formed by the wood chips flowing between the refiner plates. When energy is applied by the refiner plates to a thinner fiber pad, the compression rate applied to the wood chips becomes greater for a given energy input and results in a more efficient energy usage in refining the wood chips.

Reducing the thickness of the fiber pad allows for smaller operating gaps, e.g., the clearance between the opposing refiner plates. Reducing the gap may result in an increase in cutting of the fibers of the wood chips, a reduction of the strength properties of the pulp produced by the discs, an increased wear rate of the refiner plates and a reduction in the operating life of the refiner plates. The refiner plate operational life reduces exponentially as the operating gap is reduced.

The energy efficiency is believed to be greatest towards the periphery of the refiner discs. The relative velocities of refiner plates are greatest in the peripheral region of the plates. The refining bars on the refiner plates cross each other on opposing plates at a higher velocity in the peripheral regions of the refiner plates. The higher crossing velocity of the refining bars is believed to increase the refining efficiency in the peripheral region of the plates.

The wood fibers tend to flow quickly through the peripheral region of the refiner plates. The quickness of the fibers in the peripheral region is due to the strong centrifugal forces and forces created by the forward flow of steam generated between the discs. The shortness of the retention period in the peripheral region limits the amount of work that can be done in that most efficient part of the refining surface.

BRIEF DESCRIPTION OF THE INVENTION

Designing the refiner plates to shift more of the energy input towards the periphery of the refining zone(s) should increase the overall refining efficiency and reduce the energy consumed to refine pulp. Shifting the energy input to the periphery of the refining zone(s), a larger operating gap between the refiner plates may be sufficient to provide a long operating life for the refiner plates.

A novel refiner plate has been conceived that, in one embodiment, has enhanced energy efficiency and allows for a relatively large operating gap between discs. The energy efficiency and large operating gap may provide reduced energy consumption to produce pulp, a high fiber quality of the produced pulp, and long operating life for the refiner plate segments.

In one embodiment, the refiner plate is an assembly of rotor plate segments having an outer refining zone with bars that have at least a radially outer section with a curved longitudinal shape and leading sidewalls with wall surfaces that are jagged, serrated or otherwise irregular. The curved bars and resulting curved grooves between the bars increase the retention time of the wood chip feed material in the outer zone and thereby increase the refining of the material by the outer zone. Further, the jagged surfaces on the leading sidewalls also acts to increase the retention time of feed material in the outer zone.

A refining plate has been conceived with a refining surface facing another plate, the refining surface includes a plurality of bars upstanding from the surface, the bars extend outwardly towards an outer peripheral edge of the plate, the bars have a jagged or irregular surface on at least the leading sidewall of the bars and the bars are curved, such as with an exponential or in an involute arc. The refining plate may be a rotor plate and is arranged in a refiner opposite to another rotor plate.

A refining plate segment has been conceived for a mechanical refiner of lignocellulosic material comprising: a refining surface on a substrate, wherein the refining surface is adapted to face a refining surface of an opposing refiner plate, the refining surface including bars and grooves between the bars, wherein an angle of each bar with respect to a radial line corresponding to the bar increases at least 10 to 15 degrees along a radially outward direction, and the angle is a holdback angle in any of a range of 10 to 45 degrees, 15 to 35 degrees, 15 to 45 degrees and 20 to 35 degrees at the periphery of the refining surface, and wherein the bars each include a leading sidewall having an irregular surface, wherein the irregular surface includes protrusions extending outwardly from the sidewall towards a sidewall on an adjacent bar and the irregular surface extends from at or near the outer periphery of the refining surface extends radially inwardly along the bars without reaching an inlet of the refining surface.

The bars may each have a curved longitudinal shape with respect to a radial of the plate extending through the bar. The angles may increase continuously and gradually along the radially outward direction or in steps along the radially outward direction. At the radially inward inlet to the refining surface, the bars may be each arranged at an angle within 10, 15 or 20 degrees of a radial line corresponding to the bar. Further, the refining plate segment may be adapted for a rotating refining disc and to face a rotating refining disc when mounted in a refiner.

The refining surface may include multiple refining zones, wherein a first refining zone has relatively wide bars and wide grooves, and a second refining zone has relatively narrow bars and narrow grooves, and the second refining zone is radially outer on the plate segment from the first refining zone, wherein the holdback angle for the second refining zone may be in any of a range of degrees of 10 to 45, 15 to 45 and 20 to 35.

The irregular surface on the leading sidewall of the bars may include a series of ramps each having a lower edge at the substrate of each groove, extending at least partially up the leading sidewall.

A refiner plate has been conceived for a mechanical refiner of lignocellulosic material comprising: a refining surface on a substrate, wherein the refining surface is adapted to face a refining surface of an opposing refiner plate, and the refining surface including bars and grooves between the bars, wherein the bars have at least a radially outer section having an angle of each bar with respect to a corresponding radial line is at the inlet of the bar within 10, 15 or 20 degrees of the radial line and is a holdback angle in a range of degrees of 10 to 45, 15 to 35, 15 to 45 and 20 to 35, at an outer periphery of the bars, wherein the angle increases at least 10 to 15 degrees from a radially inward inlet of the bars to the outer periphery, and the bars each include a sidewall having an irregular surface in a radially outer section, wherein the irregular surface includes protrusions extending outwardly from the sidewall towards a sidewall on an adjacent bar, wherein the bars each include a leading sidewall having an irregular surface, wherein the irregular surface includes protrusions extending outwardly from the sidewall towards a sidewall on an adjacent bar and the irregular surface extends from at or near the outer periphery of the refining surface extends radially inwardly along the bars without reaching an inlet of the refining surface.

A refining plate segment has been conceived for a mechanical refiner of lignocellulosic material comprising: a refining surface on a substrate, wherein the refining surface is adapted to face a refining surface of an opposing refiner plate; the refining surface including bars and grooves between the bars, wherein each bar is at an angle with respect to a radial line corresponding to the bar, and the angle at the inlet to the bars is at least 10, 15 or 20 degrees of the radial line, the angle increases at least 10 to 15 degrees in a radially outward direction along the bar, and the angle is in a range of degrees of 10 to 45, 15 to 45, 15 to 35 or 20 to 35 at the periphery of the refining surface, and wherein the bars each include a leading sidewall having an irregular surface, wherein the irregular surface includes protrusions extending outwardly from the sidewall towards a sidewall on an adjacent bar and the irregular surface extends from at or near the outer periphery of the refining surface extends radially inwardly along the bars without reaching an inlet of the refining surface.

BRIEF DESCRIPTION OF THE DRAWINGS

FIGS. 9 to 12 each shows a top down view of an example of an irregular surface on a leading sidewall of a bar in the outer refining zone on a refiner plate segment.

FIG. 13 is a cross sectional diagram of a refining bar having an irregular surface on the leading sidewall of the bar.

FIG. 14 is a front view of the leading sidewall of the bar shown in FIG. 13.

DETAILED DESCRIPTION OF THE INVENTION

Figure 2:
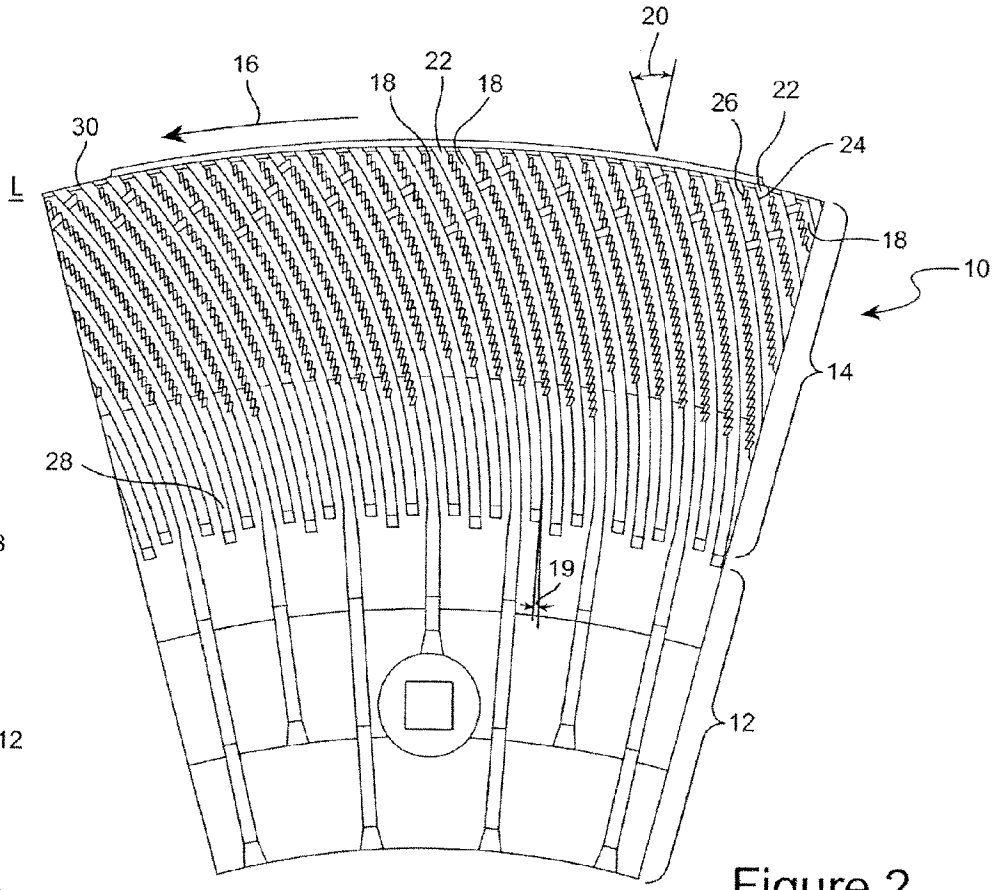
FIG. 2 is a front view of the first refiner plate segment.

The refining process applies a cyclical compression to a fibrous pad formed of wood chips moving in the operating gap between discs of a mechanical refiner. The energy efficiency of the refining process may be improved by increasing the compression rate of the fibrous pad, and reducing the percentage of the refining energy applied at lower compression rates, such as at radially inward portions of the refining zone. The increased compression rate is achieved with the rotor plate designs disclosed herein without necessarily reducing the operating gap to the same extent done with conventional higher energy efficiency refiner plates.

A relatively wide operating gap between the rotor and stator plates in a refiner (as compared to the narrow gap in high energy efficiency refiners) results in a thicker pulp pad formed between the plates. A high compression ratio is achieved with a thick pulp pad using a significantly coarser refiner plate, as compared to conventional rotor plates used in similar high energy efficiency applications.

A coarse refiner plate has relatively few bars as compared to a fine refiner plate typically used in high energy efficiency refiners. The fewer number of bars in a coarse refiner plate reduces the compression cycles applied as the bars on the rotor pass across the bars on the stator. The energy being transferred into fewer compression cycles increases the intensity of each compression and shear event and increase energy efficiency.

The rotor refiner plate designs disclosed herein achieves high fiber retention and high compression to provide high energy efficiency while preserving fiber length and improving wear life of the refiner plates. These designs are to be used in counter-rotating refiners, where similar designs would run on both rotor discs.

A refiner plate has been conceived with a relatively coarse bar and groove configuration, and other features to provide for a long retention time for the fibrous pad in the effective refining zone at a peripheral region of that zone. These features concentrate the refining energy by surface area towards the periphery of the refining surface, together with a lower number of bar crossings (less compression events) and a much longer retention time for the raw material, caused by the specific design of the rotor elements or rotor refiner plates. This results in a high compression rate of a thick fiber mat, thus maintaining a larger operating gap. Instead of achieving the high intensity by reducing the amount of fiber between the opposing plates, high intensity compressions are achieved by lowering the number of bar crossing events and increasing the amount of fiber present at each bar crossing.

The refiner plates disclosed herein may have curved bars with jagged leading side walls at least in the peripheral region of the refining zone. The curvature and jagged leading side walls of the bars slows the fibrous pad and thereby increases the retention of the pulp in the peripheral region of the refining zone. The increased retention period allows for greater energy input towards the periphery of the refiner where energy input into the pulp is more efficient.

Figure 1:
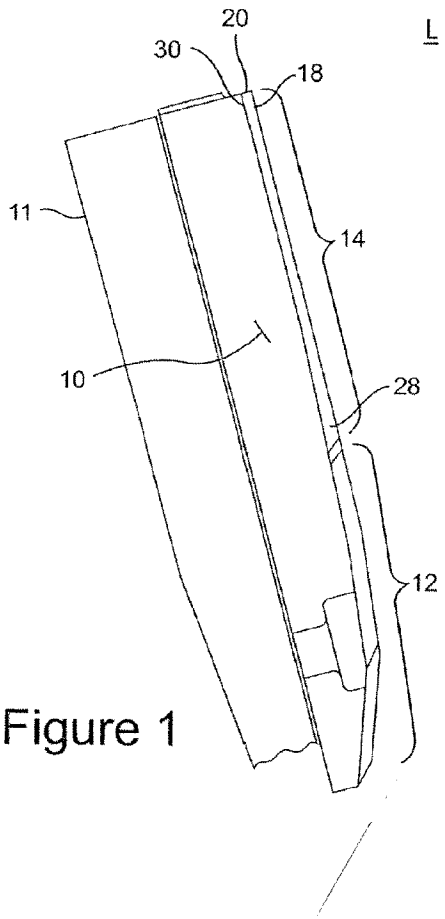
FIG. 1 is a side view of a first refiner plate segment.

FIGS. 1 and 2 shows a side view and a front view, respectively, of a rotor plate segment 10 having an inlet section 12 and an outer section 14. An array of plate segments is arranged in an annulus to form a circular refining plate. The plate segments 10 are mounted as a plate to a disc 11. In a disc refiner, the rotor plate faces another rotor plate with a refining gap between the plates. The opposite rotor plate is also formed of plate segments which may have similar bar and groove features as the first rotor plate segment, or may have other bar and groove features. The rotational direction (arrow 16) for the rotor plate is counter-clockwise.

The outer section 14 of the refiner plate segment is the area where the energy will be applied to refine the wood chip feed material. The outer section should preferably be a radial distance of between 100 millimeters (mm) to 200 mm. The outer section may be comprised of curved bars 18 which have form a step-wise or gradually increasing angle with a radial line corresponding to the bar. At the inner end 28 of each bar 18 the angle 19 between the bar and a radial line may be zero or within a few degrees, e.g., within 10, 15 or 20 degrees. The direction of the bar inlet angle 18 may be a feeding or holdback direction.

The feeding and holdback angles are the angles that a bar 18 forms with respect to the relative movement of the plates. A feeding angle is an angle from a radial line in the opposite direction to the rotation as the rotor plate, e.g., counterclockwise as indicated by arrow 16. A holdback angle is an angle from a radial line corresponding to the bar and extends in the direction of rotation of the rotor plate. A feeding angle is an angle from a radial line corresponding to the bar and extends in an opposite direction to the rotation of the plate.

At the radially outer end of the bar, the bar outlet angle 20 may be a holdback angle in a range of degrees of 10 to 45, 15 to 35, 15 to 45 or 20 to 35. The holdback angle may also be increased by providing a stepped change in the bar angle by forming each bar as a series of straight bars sections having different angles.

Grooves 22 are between the bars and are defined by the trailing sidewall 24 and leading sidewall 26 of adjacent bars. The leading sidewall faces the rotational direction of the rotor plate. In FIG. 2, the leading sidewall is on the left-hand (L) side of each bar. The grooves provide passages through which feed material, steam and other materials can move radially through the plates.

The height of the bars, e.g., the distance from the front substrate surface of the plate to the upper ridge of the bars may be initially tapered and transition to a uniform height for most of the length of the bars. The initial taper of the bars facilitates the feeding of material into the outer section 14.

In the plate segment 10, the inlet angle is neutral, e.g., approximately zero degrees with respect to a radial line. At the outer periphery 30 of the plate segment, the outlet angle 20 of the bars 18 may be a holding angle in one of the ranges of 10 to 60 degrees, 10 to 45 degrees, 20 to 30 degrees and 15 to 35 degrees.

The angle of the bars 18 gradually increases from the inlet to the outlet in an angular direction aligned with the rotation of the rotor plate. In the rotor plate segment 10, the angle increases slowly near the inlet. The rate of change of the angle gradually increases as the bar moves towards the outer periphery 30 of the plate. The increase in the angle from the inlet to the periphery of the refining zone may be at a minimum of an increase of 10 to 15 degrees. The bar angles may increase in an exponential arc or involute arc.

The high holdback angles 20 of the bars at the outer portion of the refining zone, e.g., outer section 14, contributes to the high retention of the feed material between the plates and the increased retention time of the feed material in the outer part of the refining zone, as indicated by outer section 14.

The high holdback angles, e.g., 10 to 45 degrees, and the jagged surface on the leading sidewalls of the bars may be confined to the outer region of the refining zone. The outer region may be the outer 80% to 20% of the refining zone.

Retention of feed material in the outer part of the refining zone is aided by the jagged surface of the leading sidewalls 26 of bars. The jagged surface may extend the entire height of each bar or confined to the top half or quarter of each bar. The surface of the trailing sidewalls 24 may be may be smooth. An irregular surface on a trailing sidewall could be combined with the irregular surface on the leading sidewall of the bars. The width of the bars varies due to the variable gap between the jagged surface on the leading sidewall 38 and the smooth surface of the trailing edge 30.

The jagged surfaces applied on the leading sidewalls 26 of the outlet bars may be patterns of: zig-zags, serrations, sawtooths, semi-circles, or any shape that provides increased longitudinal friction for preventing easy slippage of the feed material along the leading edge of the bars. The jagged surface may be only at an upper region of the leading sidewall. Below the jagged surface, the leading sidewall may be smooth. The sidewall surface below the jagged surface may be straight, tapered, or have ramps that extend across the groove to or towards the trailing edge of the adjacent bar.

The jagged pattern need not start at the inlet of the refining zone. The jagged portion may start radially out from the inlet to the bar and extend along the bar to the periphery 30, or its vicinity. The smooth leading sidewall at the inlet portion of the bars allows for easy feed of the fibrous pad into the refining zone. The jagged leading sidewall surface slows the movement of the feed material through the radially outward portions outer section 14 and thereby increases the retention time of the pulp near the periphery of the plates. The increased retention time allows for more refining energy to be applied to the pulp in the peripheral portion of the refining zone.

Figure 4:
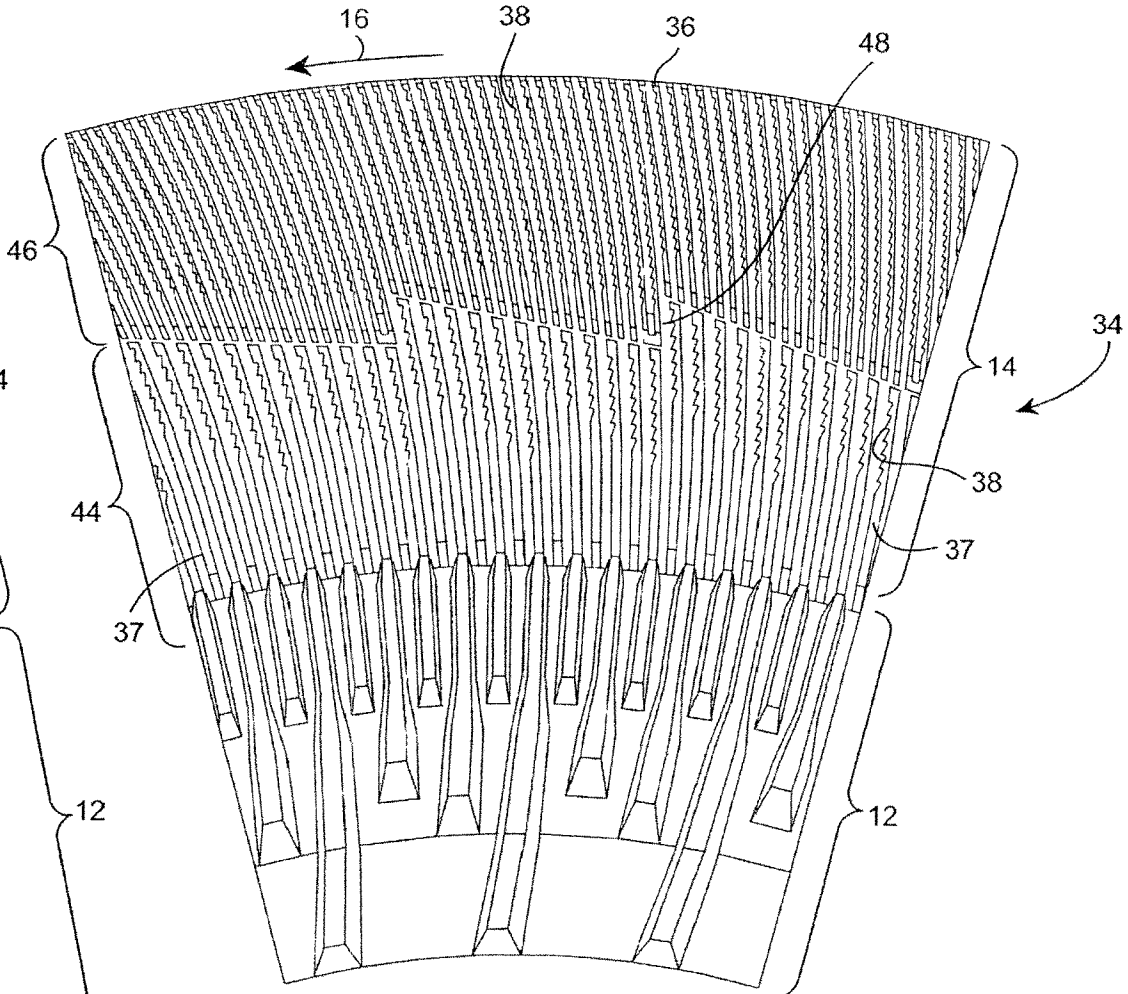
FIGS. 3 and 4 are side and front views, respectively of a second refiner plate segment.
Figure 3:
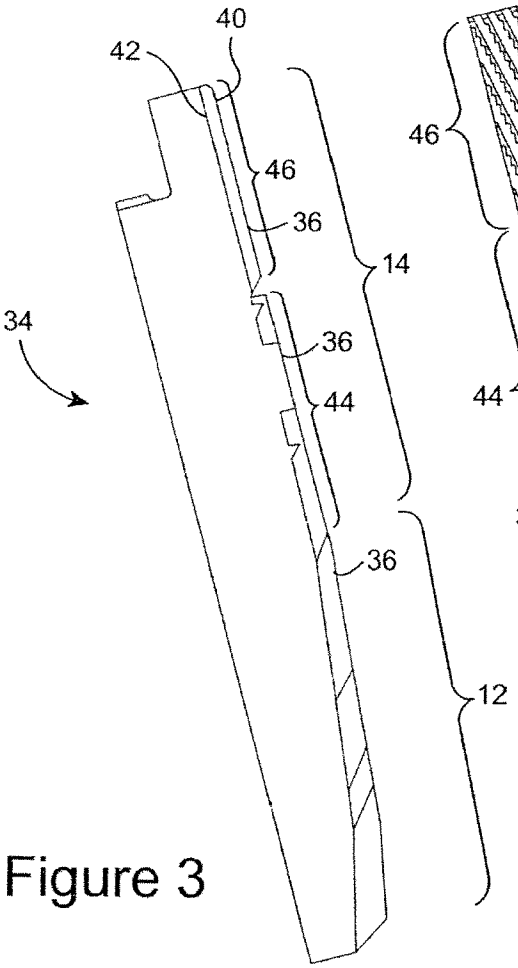

FIGS. 3 and 4 shown a side view and front view, respectively, of a plate segment 34 having bars 36 with a jagged leading sidewall 38 that appears from a top down view of the bar as a series of number sevens ("7") arranged end-to-end. The corners formed by the series of sevens may be rounded to ease manufacture and molding of the plate segments. The jagged leading sidewall may extend the entire length of the bar or may extend just a radially outer portion of the bar.

In addition, the jagged leading sidewall may be tapered from the ridge 40 towards the root (at plate substrate surface 42) of the bars, so that the jagged feature is most prominent at the upper corner of the leading sidewall of the bar where most refining is accomplished and becomes less significant as the one moves deeper into the groove.

Ramps leading up to the recesses of the jagged edges. Such ramps may also extend slightly into the grooves so that they improve the efficiency of moving pulp up into the gap for further refining.

The jagged edge surface features on the leading sidewall 38 can vary in size and shape. Preferably, the outer protrusions of the jagged corners, e.g., points on a saw-tooth shape and corners in a series of "7" shape, are spaced apart from each other by between 3 mm to 8 mm along the bar edge (length). The protrusions of the jagged edge surface features have a depth of preferably between 1.0 mm to 2.5 mm, where the depth extends in to the bar width. The depth of the protrusions may be limited by the width of the bars. A bar 36 typically has an average width of between 2.5 mm and 6.5 mm. The bar width varies due to the jagged edge surface features, particularly the protrusions, on the leading sidewall. The grooves in the outer section 14 are relatively wide in the inner refining zone 44 and narrow in the outer refining zone 46.

The plate segment 34 has an inlet section 12, e.g., a breaker bar zone, with bars having a slight curvature and generally aligned along radial lines at the periphery of the inlet section. The outer section 14 includes an inner refining zone 44 and an outer refining zone 46. The bars in the inner refining zone are thicker and fewer than the bars in the outer refining zone.

The inlet section 12 includes staggered bars which breaks large feed material particles and guides the feed material to the grooves of the outer section 14. The inner refining zone 44 of the outer section 14 receives feed material from the inlet section. The bars 37 in the inner refining zone 44 may be aligned with a radial line corresponding to the bar at the inlet to the bar, which is a zero degree holdback or feedback angle. The inner refining zone 44 refines the wood chips and provides partially refined wood chips to the inlet to the outer refining zone 42. The partial refining of the wood chips assists in feeding the chips to the outer refining zone 46 which has fine bars 36 and narrow grooves.

Multiple refining zones arranged in successive annular regions of the refining plate allow the wood chips and fibers to be initially refined by a coarse bar and groove arrangement, and successively refined by increasingly fine bar and groove arrangements. The outer refining zones with fine bar and groove patterns are suitable for producing high quality pulp which typically requires high energy compression and shear forces to be applied by the refining zones. To ensure that the fibers are retained in the outer refining zones with the fine bar and groove patters, the bars in the outer zone may have a relatively high hold back angle, e.g., 10 degrees to 45 degrees, and have jagged surfaces on the leading sidewalls of the bars. The trailing surfaces of the bars may be smooth but optionally may also be jagged or another irregular surface.

The inward section of each bar of the inner or outer refining zone may have a slot in the ridge that functions as a fine groove. The fine groove is in addition to the grooves between adjacent bars. The fine groove may discharge through a cross-over groove that opens to the leading sidewall at a location on the bar radially inward of the jagged section of the leading sidewall.

The jagged surface 38 of the leading sidewalls in the inner and outer refining zones need not extend the entire length of the bar. Also, the jagged surface 38 of the different bars in each refining zone 44, 46 need not cover the same portion of each bar.

The inlets of the bars or radial inner most portions of the jagged leading sidewalls may be at a common radial distance on the refiner plate as shown in FIGS. 2 and 4. Alternatively, the inlet to the bars or the start of the jagged sidewalls may form a Z-pattern as shown in the outer refining zone 46. At the radially inward most portion of each Z-pattern, the adjacent bars may be joined at their inlet such that a half-height dams 48 is formed. Whether the bar inlets are at a common radius, form a Z-pattern or have another arrangement may be selected based on the requirements for the refiner plate. Similarly, the pattern of the start of the jagged sidewall, e.g., a Z-patter, common radial line or steps of multiple bars (see bars 86 in FIG. 8), may be selected based on the requirements of the refiner plate.

The plate segment 34 has coarse jagged surfaces on the leading sidewalls of the bars in the inner refining zone 44, wherein the term coarse refers to the frequency of protrusions on the jagged surface. In contrast, the outer refining zone has a fine jagged surface on the leading sidewall. The coarseness of the jagged surface is dependent, in part, on the thickness of the bars and the number of bars in the refining zone.

The plates having two or more annular refining zones, such as zones 44 and 46, may be used for producing high quality pulp. High quality pulp may be produced using fine bars and narrow grooves that apply large compression and shear forces to the fibers. Fine bars and narrow grooves may not be suited to refining whole wood chips or large sized particles of material. The inner refining zone(s) refine the whole wood chips and larger sized particles of material into pulp fibers that can be processed by the refining zones with fine bars and narrow grooves.

The fine bars with narrow grooves at the outer radial regions of the refiner plate impart large compressive and shear forces to the pulp to produce high quality pulp. The curvature of the bars and the jagged leading sidewall surfaces in the outer radial refining region, e.g., the outer one-third of the refining zone, increase the retention period of fibers in the outer refining zone. The increased retention allows additional work to be imparted to the fibers by the outer refining zone. Because of the outer refining zone and the amount of pulping work accomplished in the outer zone, gap between the opposing rotor plates need not be as small as used in certain conventional refiners where a narrow gap between plates is used to increase the work applied to the wood chips.

Figures 5, 6:
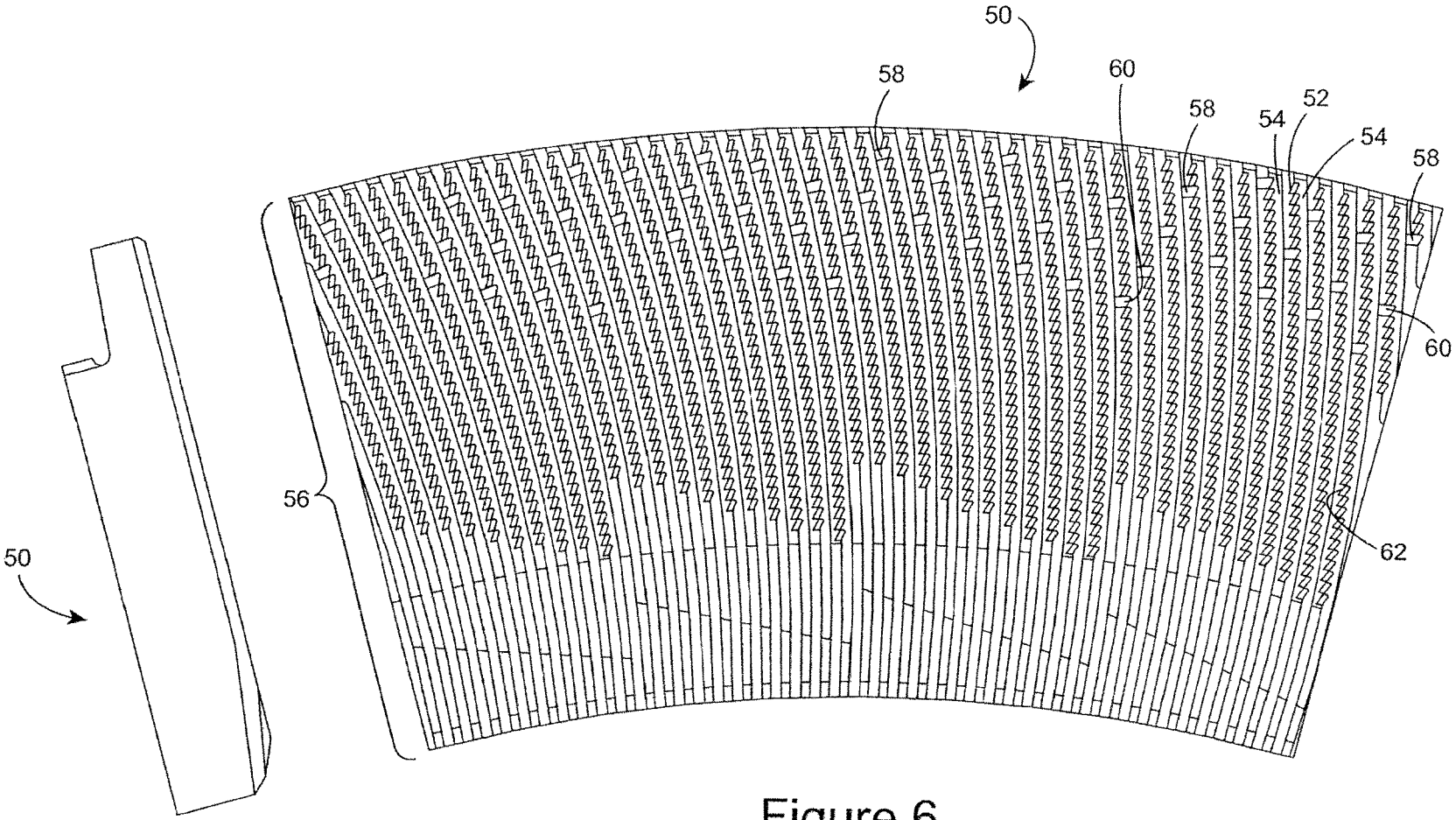
FIGS. 5 and 6 are side and front views, respectively of a third refiner plate segment.

FIGS. 5 and 6 show a side view and front view, respectively, of a rotor refiner plate segment 50. The grooves 52 separating the bars 54 in the refining zone 56 may have a combination of surface (full height) dams 58, subsurface or half-height dams 60, or no dams at all, depending on the overall plate design combination and operational conditions for the refiner plate.

Figure 7:
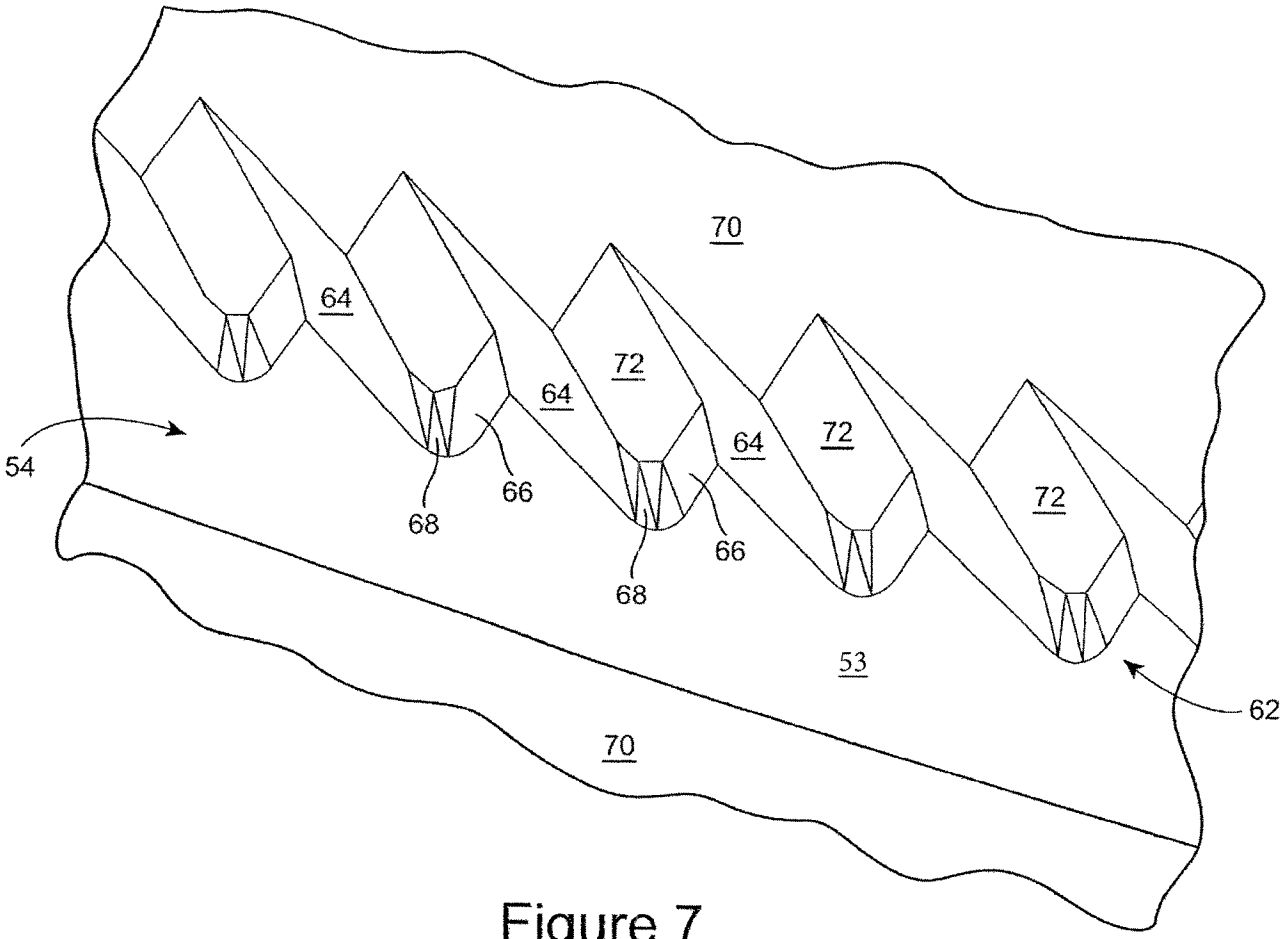
FIG. 7 is an enlarged view of an example of a jagged sidewall of a bar on a refiner plate segment.

FIG. 7 shows an embodiment of the jagged surface 62 on the leading sidewall of the bars. The jagged surface 62 may be formed of repeating protrusions having a first straight sidewall 64, a second straight sidewall 66 and a curved sidewall 68 between the first and second sidewalls. A sloped ramp 72 extends up from the substrate 70 (at the bottom of the groove) to the bottom edge of the second sidewall 66.

The top edge of the second sidewall 66, the interior corner 68 and the first sidewall 64 are at the ridge 53 at the top of the bar. The first and second sidewalls may be substantially perpendicular to each other, or may form an angle in a range of 45 degrees to 120 degrees. Alternatives to the ramp include: the ramp 72 extending to the ridge 53 of the bar, the ramp may having a lower edge above the substrate at the bottom of the groove, or not including the ramp 72.

The sloped surface 72 extending from the substrate may raise or lift fiber out of the groove and move the fiber to the upper regions of the bars where much of the refining is accomplished. The length and angle of the sloped surface 72 is dependent on the desired extend of the jagged surface dimension, and the angle and length selected for the sloped surface.

Figure 8:
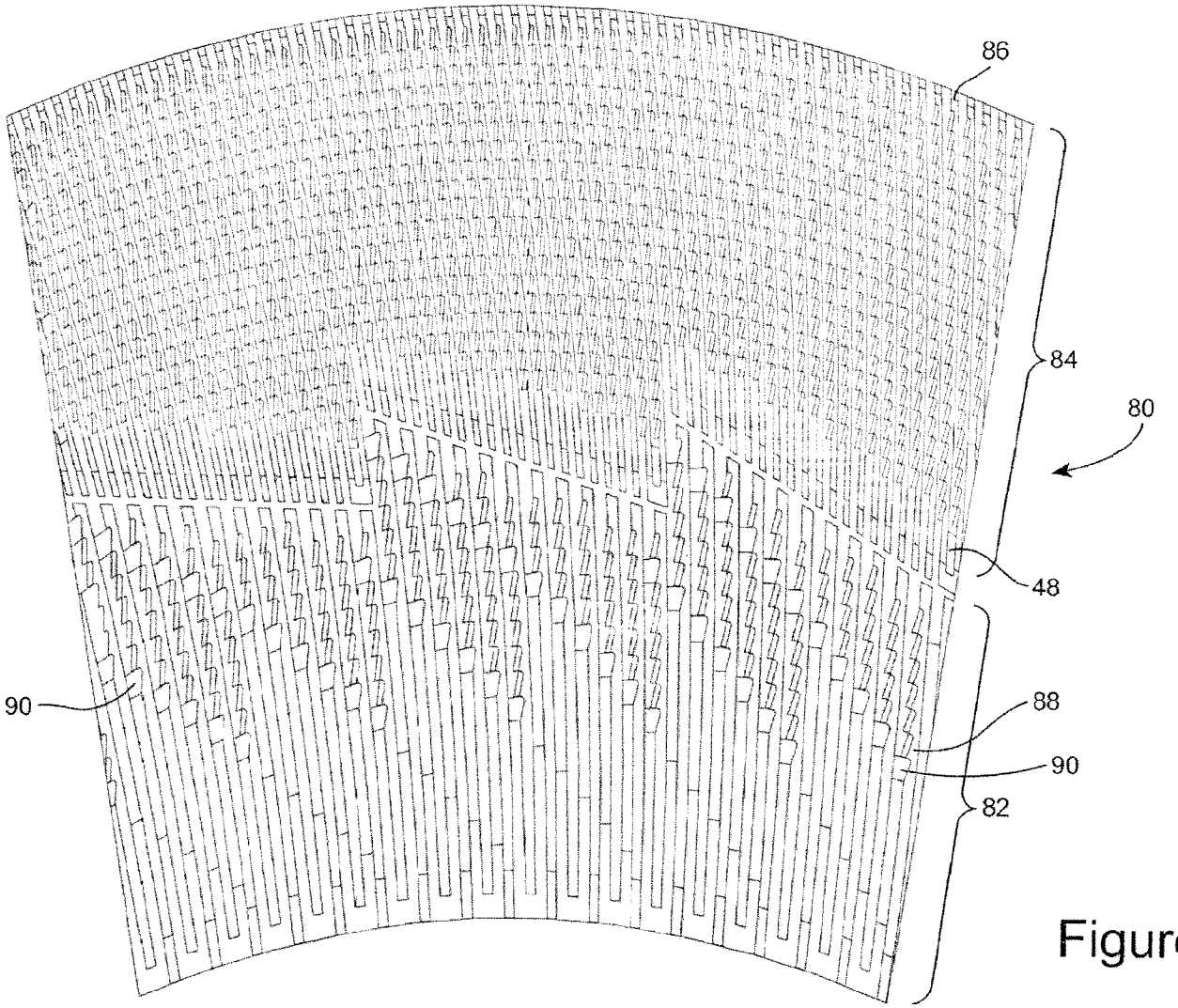
FIG. 8 is a front view of another refiner plate segment.

FIG. 8 is a front view of a plate segment 80 having an inner refining zone 82 and an outer refining zone 84. The bars 86 in the outer refining zone 84 are each arranged parallel a respective radial line or are arranged at a small feeding or holdback angle, such as within 10 or 5 degrees of a radial line. The bars 86 are curved such that at their outer radial end they form a holdback angle of 10 to 45 degrees. The inlet to the bars 86 in the outer refining zone may form a Z-pattern and the radially inward portion of each of the jagged sidewall surfaces form a step pattern form of groups of three bars.

The bars 88 of the inner refining zone 82 have an inlet angle of zero may be straight or curved to gradually form a slight holdback angle, e.g., 5 to 15 degrees at the transition between the inner and outer refining zones. The jagged surface on the leading sidewall of the bars 88 in the inner refining zone is optional and may be substantially coarser than the jagged surface on the radially outward bars 86. Alternatively, the coarseness of the jagged surface may be uniform across the entire plate. Further, the jagged surface may be finer in the outer refining zone than in an inner refining zone. A half-height dam 90 may be positioned in the grooves of the inner refining zone.

FIGS. 9 to 12 are each a top down view of the ridge 126 and particularly the profile of the irregular surface on a leading sidewall of a bar in the outer refining zone of a refiner plate segment. The upper ridge 126 of each bar 120 includes a profile of the upper corner of the leading sidewall 128 and the trailing sidewall 130. The leading sidewall has an irregular surface, e.g., serrated feature that may be most pronounced at the upper corner of the sidewall. The irregular surface features of the leading sidewalls 128 may be confined to the outer radial portions of the bar, but may extend the entire length of the outermost refining zone or the entire refining zone.

The irregular surface features may have a variety of shapes, including the series of "7"s shown in FIG. 9, the saw tooth feature shown in FIG. 10, the series of concave grooves in the leading sidewall as shown in FIG. 11, and a series of teeth, e.g., rectangular teeth, as shown in FIG. 12. The shape of the irregular features is a matter of design preference and may depend on the feed material, and plate segment composition, manufacturing and molding considerations.

FIG. 13 shows in cross section a bar 120 having a smooth trailing sidewall 130 and an irregular surface, e.g., series of "7"s, on the leading sidewall 128. FIG. 14 shows in front view the same irregular surface feature on the bar leading sidewall as shown in FIG. 13. The irregular surface feature may be more pronounced on the bar sidewall near the bar ridge 126 where most refining occurs. The irregular surface feature may become progressively less pronounced on bar sidewall in the direction of the plate substrate 122. The protrusions 176 of the irregular surface tend to retard the movement of feed material through the grooves and thereby increase the retention time of feed material in the refining zone(s) of the plates. The protrusions 176 may be tapered from ridge 126 to substrate 122. Near the substrate 122 of the plate the protrusions may blend into a smooth lower surface 78 of the leading sidewall 128.

The curved bars, jagged surfaces for the leading sidewalls of the bars and holdback angles of 10 to 45 degrees may be applied to the plate segments on either or both opposing discs in a refiner.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed:

1. A refining plate segment for a mechanical refiner of lignocellulosic material comprising:

a refining surface on a first substrate, wherein the refining surface is adapted to face a second refining surface on a second substrate of an opposing refiner plate, the refining surface including bars and grooves between the bars, wherein an angle of each bar with respect to a radial line corresponding to the bar increases at least 15 degrees along a radially outward direction, and the angle is a holdback angle in a range of 10 to 45 degrees at the periphery of the refining surface, wherein the bars each include a trailing sidewall extending from an upper surface of the bar to the first substrate, wherein a smooth surface extends the length of the trailing sidewall;

wherein the bars each include a leading sidewall having an irregular surface, wherein the irregular surface includes teeth extending outwardly from the sidewall towards a sidewall on an adjacent bar and the irregular surface extends radially inwardly along the bar, wherein the teeth each include a first surface extending from the first substrate towards a top of the bar with the teeth and a second surface extending from the first surface to the top of the bar, wherein a slope of the first surface with respect to the first substrate is smaller than a slope of the second surface, wherein each of the teeth includes a corner formed at an interface of the first surface, the first substrate, a third surface extending from an edge of the first surface to the first substrate, and wherein the third surface forms an oblique angle with respect to the trailing sidewall of the bar such that the third surface and the corner associated with the third surface project obliquely from the leading sidewall into the groove.

2. The refining plate segment of claim 1 wherein the bars each have a curved longitudinal shape with respect to a radial of the plate extending through the bar.

3. The refining plate segment of claim 1 wherein the holdback angle increases continuously and gradually along the radially outward direction.

4. The refining plate segment of claim 1 wherein the angle increases in steps along the radially outward direction.

5. The refining plate segment of claim 1 wherein at a radially inward inlet to the refining surface, the bars are each arranged at an angle within 10 to 20 degrees of a radial line corresponding to the bar.

6. The refining plate segment of claim 1 wherein the refining plate segment is adapted for a rotating refining disc and to face a rotating refining disc when mounted in a refiner.

7. The refining plate segment of claim 1 wherein the refining surface includes multiple refining zones, wherein a first refining zone has relatively wide bars and wide grooves, and a second refining zone has relatively narrow bars and narrow grooves, and the second refining zone is radially outward on the plate segment of the first refining zone.

8. The refining plate segment of claim 7 wherein the holdback angle refers to the bars of the second refining zone.

9. The refining plate segment of claim 1 wherein the irregular surface includes a series of ramps each extending at least partially up the leading sidewall.

10. A refiner plate for a mechanical refiner of lignocellulosic material comprising:

a first refining surface on a first substrate, wherein the refining surface is adapted to face a second refining surface of an opposing refiner plate, and the first refining surface includes bars and grooves between the bars, wherein the bars each include a trailing sidewall extending from an upper surface of the bar to the first substrate, wherein trailing sidewall has a smooth surface along the length of the trailing sidewall;

wherein the bars have at least a radially outer section having an angle of each bar with respect to a corresponding radial line and wherein the angle at a radially innermost end of the bar has a range of 10 to 20 degrees from the radial line and wherein the angle is known as a holdback angle, wherein the holdback angle has a range of 10 to 45 degrees at an outer periphery of the bars, wherein the angle increases at least 10 to 15 degrees from the radially innermost end of the bars to the outer periphery, and the bars each include a leading sidewall having an irregular surface, wherein the irregular surface includes teeth extending outwardly from the leading sidewall towards a trailing sidewall on an adjacent bar and the irregular surface extends radially inwardly along the bars, wherein the teeth each include a first surface extending from the first substrate towards a top of the bar with the teeth, a second surface extending from the first surface to the top of the bar and a third surface extending from an edge of the first surface to the first substrate, wherein a slope of the first surface with respect to the substrate is smaller than a slope of the second surface, and wherein each of the teeth includes a corner formed at the interface of the first surface, the third surface and the substrate, and wherein the third surface forms an oblique angle with respect to the trailing sidewall such that the third surface and the corner associated with the third surface project obliquely from the leading sidewall into the groove.

11. The refining plate of claim 10 wherein the bars each have a curved longitudinal shape with respect to a radial of the plate extending through the bar.

12. The refining plate of claim 10 wherein the holdback angle increases continuously and gradually along the radially outward direction.

13. The refining plate of claim 10 wherein the angle increases in steps along the radially outward direction.

14. The refining plate of claim 10 wherein at a radially inward inlet to the refining surface, the bars are each arranged at an angle within 10 to 20 degrees of a radial line corresponding to the bar.

15. The refining plate of claim 10 wherein the refining plate segment is adapted for a rotating refining disc and to face a rotating refining disc when mounted in a refiner.

16. The refiner plate segment of claim 10 wherein the teeth of the irregular surface form a pattern that is at least one of a zig-zag, sawtooth, series of bumps, sinusoid, and sideways Z-pattern.

17. The refiner plate segment of claim 10 wherein the teeth on the irregular surface vary the width of the bar by at least one-fifth the width of the bar along the portion of the bar having the sidewall with the irregular surface.

18. The refiner plate segment of claim 10 wherein the refining surface includes an outer refining surface having a higher density of bars than a density of bars in an inner refining section.

19. The refining plate segment of claim 10 wherein the teeth of the irregular surface are most pronounced at an upper edge of the sidewall and are less pronounced proximate a substrate of the plate.

20. The refining plate of claim 10 wherein the refining surface includes multiple refining zones, wherein a first refining zone has relatively wide bars and wide grooves, and a second refining zone has relatively narrow bars and narrow grooves, and the second refining zone is radially outer on the plate segment from the first refining zone.

21. The refining plate of claim 20 wherein the holdback angle refers to the bars of the second refining zone.

22. The refining plate of claim 10 wherein the irregular surface includes a series of ramps extending at least partially up the leading sidewall.

23. A refining plate segment for a mechanical refiner of lignocellulosic material comprising:

a refining surface on a substrate, wherein the refining surface is adapted to face a refining surface of an opposing refiner plate;

the refining surface including bars and grooves between the bars, wherein the bars each include a trailing sidewall extending from an upper surface of the bar to the substrate, wherein trailing sidewall has a smooth surface along the length of the trailing sidewall;

wherein each bar is at an angle with respect to a radial line corresponding to the bar, and the angle at the inlet to the bars is in a range of 10 to 20 degrees of the radial line, the angle increases at least 15 degrees in a radially outward direction along the bar, and the angle is in a range of 10 to 45 degrees at the periphery of the refining surface, wherein the bars each include a leading sidewall having an irregular surface, wherein the irregular surface includes teeth extending outwardly from the leading sidewall towards the trailing sidewall on an adjacent bar and the irregular surface extends radially inwardly along the bar without reaching an inlet of the refining surface, and wherein the teeth each include a first surface extending from the first substrate towards a top of the bar with the teeth, a second surface extending from the first surface to the top of the bar, and a third surface extending from an edge of the first surface to the substrate;

wherein a slope of the first surface with respect to the substrate is smaller than a slope of the second surface, wherein each of the teeth includes a corner formed at the interface of the first surface, the third surface and the substrate, and the third surface forms an oblique angle with respect to the trailing sidewall such that the third surface and the corner associated with the third surface project obliquely from the leading sidewall into the groove.

24. The refining plate segment of claim 23 wherein the bars each have a curved longitudinal shape with respect to a radial of the plate extending through the bar.

25. The refining plate segment of claim 23 wherein the angle increases continuously and gradually along the radially outward direction.

26. The refining plate segment of claim 23 wherein the angle increases in steps along the radially outward direction.

27. The refining plate segment of claim 23 wherein the refining plate segment is adapted for a rotating refining disc and to face a rotating refining disc when mounted in a refiner.

28. The refiner plate segment of claim 23 wherein the teeth of the irregular surface form a pattern that is at least one of a zig-zag, sawtooth, series of bumps, sinusoid, and sideways Z-pattern.

29. The refiner plate segment of claim 23 wherein the teeth on the irregular surface vary the width of the bar by at least one-fifth the width of the bar along the portion of the bar having the sidewall with the irregular surface.

30. The refiner plate segment of claim 23 wherein the refining surface includes an outer refining surface having a higher density of bars than a density of bars in an inner refining section.

31. The refining plate segment of claim 23 wherein the teeth of the irregular surface are most pronounced at an upper edge of the sidewall and are less pronounced proximate a substrate of the plate.

32. The refining plate segment of claim 23 wherein the refining surface includes multiple refining zones, wherein a first refining zone has relatively wide bars and wide grooves, and a second refining zone has relatively narrow bars and narrow grooves, and the second refining zone is radially outwards on the plate segment from the first refining zone.

33. The refining plate segment of claim 32 wherein the holdback angle refers to the bars of the second refining zone.

34. The refining plate segment of claim 23 wherein the irregular surface includes a series of ramps each having a lower edge at the substrate of each groove, extending at least partially up the leading sidewall.

35. The refining plate segment of claim 1 wherein the irregular surfaces of the sidewalls of the bars include a coarse irregular surface on the sidewalls and a fine irregular surface on the sidewalls, and the coarse irregular surfaces radially are inward outward of the fine irregular surfaces.

36. The refining plate segment of claim 1 wherein the irregular surface is along a radially outward portion of the bar and the bars include a smooth surface along a radially inward portion of the bar, the bars are arranged in groups of three or more bars and in each group the bars extend from a first bar to a last bar in a direction opposite to a rotational direction of the mechanical refiner, and in each of the groups, the irregular surface on the leading sidewall of each of the bars extends further radially inwardly than does the next bar in the group in a direction opposite to a direction of rotation of the mechanical refiner, except for the last bar in the group that has the irregular surface extending further radially inwardly than the other bars of the group.

37. The refining plate segment of claim 10 wherein the irregular surfaces of the sidewalls of the bars include a coarse irregular surface on the sidewalls and a fine irregular surface on the sidewalls, and the coarse irregular surfaces are radially inward outward of the fine irregular surfaces.

38. The refining plate segment of claim 10 wherein the irregular surface is along a radially outward portion of the bar and the bars include a smooth surface along a radially inward portion of the bar, the bars are arranged in groups of three or more bars and in each group the bars extend from a first bar to a last bar in a direction opposite to a rotational direction of the mechanical refiner, and in each of the groups, the irregular surface of each of bars extends further radially inwardly than does the next bar in the group in a direction opposite to a direction of rotation of the mechanical refiner, except for the last bar in the group that has the irregular surface extending further radially inwardly than the other bars of the group.

39. The refining plate segment of claim 23 wherein the irregular surfaces of the sidewalls of the bars include a coarse irregular surface on the sidewalls and a fine irregular surface on the sidewalls, and the coarse irregular surfaces are radially inward outward of the fine irregular surfaces.

40. The refining plate segment of claim 23 wherein the irregular surface is along a radially outward portion of the bar and the bars include a smooth surface along a radially inward portion of the bar, the bars are arranged in groups of three or more bars and in each group the bars extend from a first bar to a last bar in a direction opposite to a rotational direction of the mechanical refiner, and in each of the groups, the irregular surface of each of bars extends further radially inwardly than does the next bar in the group in a direction opposite to a direction of rotation of the mechanical refiner, except for the last bar in the group that has the irregular surface extending further radially inwardly than the other bars of the group.

* * * * *